US011750978B2

(12) United States Patent
Yan et al.

(10) Patent No.: US 11,750,978 B2
(45) Date of Patent: Sep. 5, 2023

(54) SOUND GENERATOR

(71) Applicant: AAC Microtech (Changzhou) Co., Ltd., Changzhou (CN)

(72) Inventors: Xudong Yan, Shenzhen (CN); Tao Shao, Shenzhen (CN); Xiaojiang Gu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 46 days.

(21) Appl. No.: 17/535,720

(22) Filed: Nov. 26, 2021

(65) Prior Publication Data

US 2022/0174415 A1 Jun. 2, 2022

(30) Foreign Application Priority Data

Nov. 30, 2020 (CN) ..... 202011384279.X

(51) Int. Cl.
*H04R 9/02* (2006.01)
*H04R 9/04* (2006.01)

(52) U.S. Cl.
CPC ..... *H04R 9/025* (2013.01); *H04R 9/046* (2013.01)

(58) Field of Classification Search
CPC . H04R 9/06; H04R 9/10; H04R 9/025; H04R 9/063; H04R 2209/08; H04R 1/222; H04R 11/04
See application file for complete search history.

(56) References Cited

U.S. PATENT DOCUMENTS 7,142,686 B2 * 11/2006 Furuya ..... H04R 9/063 381/396
2016/0212545 A1 * 7/2016 Morgan ..... H02K 1/27
2019/0028812 A1 * 1/2019 Merewether ..... H04R 1/2811
(Continued)

FOREIGN PATENT DOCUMENTS

CN 211959524 U 11/2020
CN 112468941 A 3/2021

OTHER PUBLICATIONS

1st Office Action dated Apr. 30, 2021 by SIPO in related Chinese Patent Application No. 202011384279.X(7 Pages).
(Continued)

*Primary Examiner* — Maria El-Zoobi
*Assistant Examiner* — Julie X Dang
(74) *Attorney, Agent, or Firm* — W&G Law Group

(57) ABSTRACT

Disclosed is a sound generator, including a bracket, a magnetic circuit system, a first vibration system, and a second vibration system. The bracket has a first opening and a second opening that face opposite directions. The magnetic circuit system is used for driving the first vibration system and the second vibration system to generate sound in different directions. The first vibration system includes a first voice coil, the second vibration system includes a second voice coil, and the magnetic circuit system includes a first magnet, a second magnet, and a third magnet. The first voice coil is sleeved on outer sides of the first magnet and the second magnet simultaneously, and the second voice coil is sleeved on outer sides of the second magnet and the third magnet simultaneously. In the present invention, the loudness of sound generated by the sound generator may be improved.

10 Claims, 6 Drawing Sheets

(56) References Cited

U.S. PATENT DOCUMENTS

| | | | | |
|---|---|---|---|---|
| 2020/0037078 | A1* | 1/2020 | Scheek | H04R 9/025 |
| 2020/0169814 | A1* | 5/2020 | Bushko | H04R 9/025 |

OTHER PUBLICATIONS

2nd Office Action dated Sep. 27, 2021 by SIPO in related Chinese Patent Application No. 202011384279 X(6 Pages).
PCT search report dated May 26, 2021 by SIPO in related PCT Patent Application No. PCT/CN2020/139032 (4 Pages).

* cited by examiner

SOUND GENERATOR

TECHNICAL FIELD

The present invention relates to the technical field of sound generation, and in particular, to a sound generator.

BACKGROUND ART

In order to achieve better sound effects in the related art, a sound generator is generally designed to generate sound from both sides, that is, as a double-sided sound generator. The double-sided sound generator is provided with a magnetic circuit system and two sets of vibration systems that are driven by the magnetic circuit system simultaneously, such that the two sets of vibration systems generate sound separately to achieve the purpose of making the sound generator have a better sound effect. However, the magnetic circuit efficiency of a magnetic circuit system of an existing sound generator is low, resulting in poor sound generation effects of the two sets of vibration systems.

Therefore, there is a need to provide a sound generator with better sound generation effects.

SUMMARY OF THE INVENTION

The object of the present invention is to provide a sound generator, which may improve the loudness of sound generated by the sound generator.

The technical solution of the present invention is as follows: a sound generator, comprising a bracket, and a magnetic circuit system, a first vibration system, and a second vibration system that are fixedly connected to the bracket, wherein the bracket has a first opening and a second opening that face opposite directions, the magnetic circuit system is used for driving the first vibration system to generate sound in a first direction from the second opening toward the first opening and driving the second vibration system to generate sound in a second direction opposite to the first direction, the first vibration system comprises a first voice coil, and the second vibration system comprises a second voice coil; and wherein the magnetic circuit system comprises a first magnet, a second magnet, and a third magnet that are sequentially spaced and oppositely disposed in the second direction, wherein the polarity of a magnetic pole, which is opposite to the second magnet, of the first magnet is the same as the polarity of a magnetic pole, which is opposite to the first magnet, of the second magnet, the polarity of a magnetic pole, which is opposite to the third magnet, of the second magnet is the same as the polarity of a magnetic pole, which is opposite to the second magnet, of the third magnet, the first voice coil is sleeved on outer sides of the first magnet and the second magnet simultaneously, and the second voice coil is sleeved on outer sides of the second magnet and the third magnet simultaneously.

Optionally, the magnetic circuit system further comprises a first pole core and a second pole core, wherein the first pole core is disposed between the first magnet and the second magnet and is disposed opposite to the first voice coil in a direction perpendicular to the first direction, and the second pole core is disposed between the second magnet and the third magnet and is disposed opposite to the second voice coil in a direction perpendicular to the second direction.

Optionally, a center point of the first voice coil coincides with a center point of the first pole core, and a center point of the second voice coil coincides with a center point of the second pole core.

Optionally, the size of the first magnet is the same as that of the third magnet, the area of the cross section of the second magnet in a third direction perpendicular to the first direction is equal to that of the cross section of the first magnet in the third direction, and the height of the second magnet in the first direction is greater than that of the first magnet in the first direction.

Optionally, the magnetic circuit system further comprises a first magnetic frame and a second magnetic frame, wherein the first magnetic frame is provided with a first receiving space where the first magnet, a part of the second magnet, the first pole core, and the first voice coil are all accommodated, and the second magnetic frame is provided with a second receiving space where the third magnet, a part of the second magnet, the second pole core, and the second voice coil are all accommodated.

Optionally, the first magnetic frame comprises a top wall, a plurality of first side walls spaced apart from each other, and a plurality of first limiting portions, wherein the plurality of first side walls spaced apart from each other surround the periphery of the top wall to form the first receiving space, and each of the first limiting portions is fixedly connected to the top wall and located between two adjacent ones of the first side walls; and the second magnetic frame comprises a bottom wall, a plurality of second side walls spaced apart from each other, and a plurality of second limiting portions, wherein the plurality of second side walls spaced apart from each other surround the periphery of the bottom wall to form the second receiving space, and each of the second limiting portions is fixedly connected to the bottom wall and located between two adjacent ones of the second side walls.

Optionally, the bracket comprises a body portion and a plurality of bearing portions spaced apart from each other, wherein the body portion is provided with an accommodation space, and each of the bearing portions has a first end portion and a second end portion that are disposed back to back, a first end surface facing the first opening, and a second end surface facing the second opening, wherein the first end portion of each of the bearing portions is connected to the side of the body portion that faces the accommodation space, the second end portions of the bearing portions surround to form a mounting channel where the second end surface is located and a part of the second magnetic frame is disposed, each of the second side walls is connected to the second end surface of each of the bearing portions, and each of the first side walls is connected to the first end surface of each of the bearing portions.

Optionally, the first vibration system further comprises a first dome which comprises a first main body portion, two first connection portions disposed oppositely, and a first holding portion connected to the first main body portion, wherein the first main body portion has a first surface facing the first opening and a second surface facing the second opening, the two first connection portions disposed oppositely are disposed on the second surface with one of them disposed between two adjacent ones of the bearing portions, and the first holding portion is provided with a first through hole, sleeved on the outer side of the first magnet through the first through hole and connected to the side of the first voice coil that is close to the top wall; and the second vibration system further comprises a second dome disposed on the side of the bearing portion that faces away from the first magnetic frame, the second dome comprising a second main body portion, two second connection portions disposed oppositely, and a second holding portion, wherein the second main body portion has a third surface facing the first opening and a fourth surface facing the second opening, the two second connection portions disposed oppositely are disposed on the third surface with one of them disposed between two adjacent ones of the bearing portions and the other located between the two first connection portions disposed oppositely, and the second holding portion is provided with a second through hole, sleeved on the outer side of the second magnet through the second through hole and connected to the side of the second voice coil that is close to the bottom wall.

Optionally, the first vibration system further comprises a first sound membrane and a second sound membrane located on an outer side of the first sound membrane, wherein the first sound membrane is provided with a first aperture, sleeved on an outer side of the first magnetic frame through the first aperture and has a first connection surface facing the second opening, a part of the first connection surface that is close to the first aperture being connected to the plurality of first limiting portions, and a part of the first connection surface that faces away from the first aperture being connected to the first main body portion, and the second sound membrane is connected between the first main body portion and the body portion; and the second vibration system further comprises a third sound membrane and a fourth sound membrane located on an outer side of the third sound membrane, wherein the third sound membrane is provided with a second aperture, sleeved on an outer side of the second magnetic frame through the second aperture and has a second connection surface facing the first opening, a part of the second connection surface that is close to the second aperture being connected to the plurality of second limiting portions, and a part of the second connection surface that faces away from the second aperture being connected to the second main body portion, and the fourth sound membrane is connected between the second main body portion and the body portion.

Optionally, the first vibration system further comprises a first connection piece, which is provided with a first connection hole, fixedly connected to the first magnetic frame through the first connection hole and connected to the first sound membrane, and the second vibration system further comprises a second connection piece, which is provided with a second connection hole, fixedly connected to the second magnetic frame through the second connection hole and connected to the second sound membrane.

The beneficial effect of the present invention is that the magnetic circuit system of the present invention comprises a first magnet, a second magnet, and a third magnet that are sequentially spaced and oppositely disposed, wherein the first magnet and the second magnet may provide magnetic fields for the first voice coil simultaneously, and the second magnet and the third magnet may provide magnetic fields for the second voice coil simultaneously. Compared with a magnetic circuit system using only two magnets, the magnetic circuit efficiency of the magnetic circuit system may be improved in the present invention, so that vibration amplitudes of the first voice coil and the second voice coil are increased, thereby improving the loudness of sound generated by the sound generator.

DETAILED DESCRIPTION OF EMBODIMENTS

The present invention will be further described in conjunction with the accompanying drawings and embodiments below.

Figure 1:
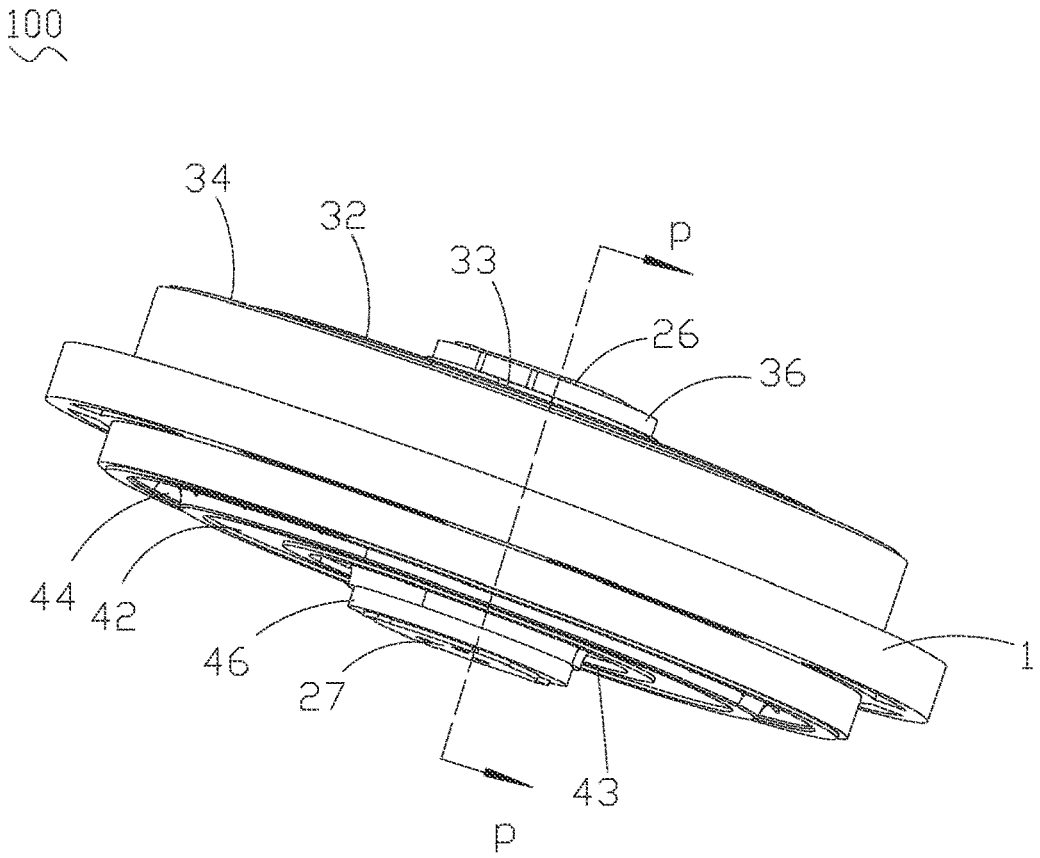
FIG. 1 is a first schematic structural diagram of a sound generator provided by the present invention.
Figure 2:
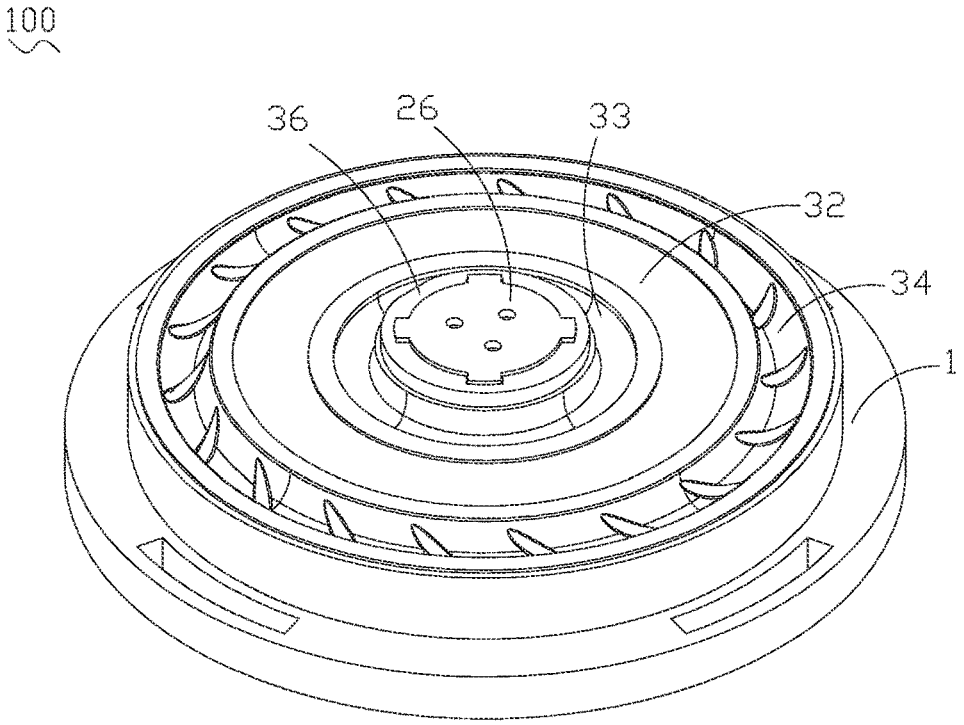
FIG. 2 is a second schematic structural diagram of the sound generator provided by the present invention.
Figure 3:
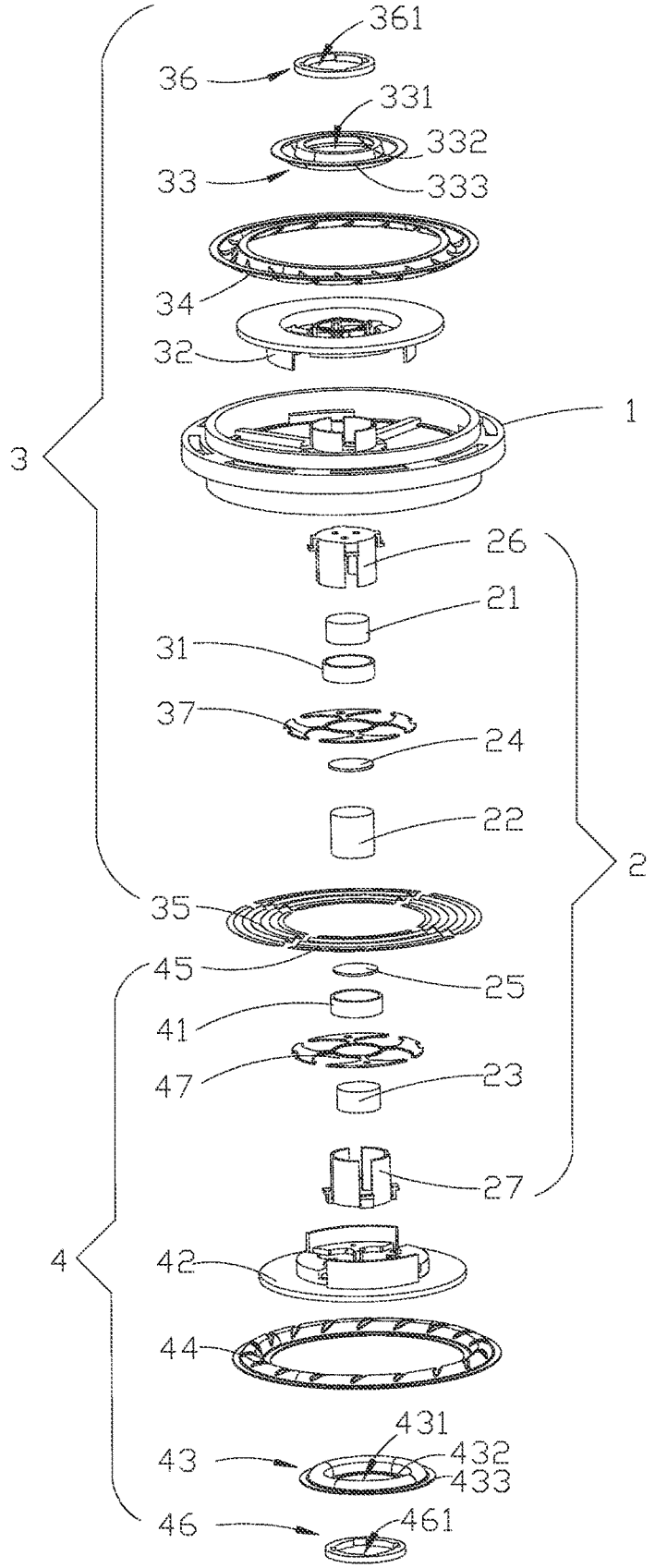
FIG. 3 is an exploded view of the sound generator shown in FIG. 2.

Referring to FIGS. 1-3, a sound generator 100 comprises a bracket 1, a magnetic circuit system 2, a first vibration system 3, and a second vibration system 4. The magnetic circuit system 2, the first vibration system 3, and the second vibration system 4 are fixedly connected to the bracket 1. The magnetic circuit system 2 is used for driving the first vibration system 3 and the second vibration system 4 to generate sound in opposite directions.

The bracket 10 has a first opening 11 and a second opening 12 that face opposite directions. The magnetic circuit system 2, the first vibration system 3, and the second vibration system 4 are all fixedly connected to the bracket 10. The magnetic circuit system 20 is used for driving the first vibration system 30 to generate sound in a first direction from the second opening 12 toward the first opening 11 and drive the second vibration system 4 to generate sound in a second direction opposite to the first direction, so that the sound generator 100 achieves the effect of generating sound from both sides.

Figure 4:
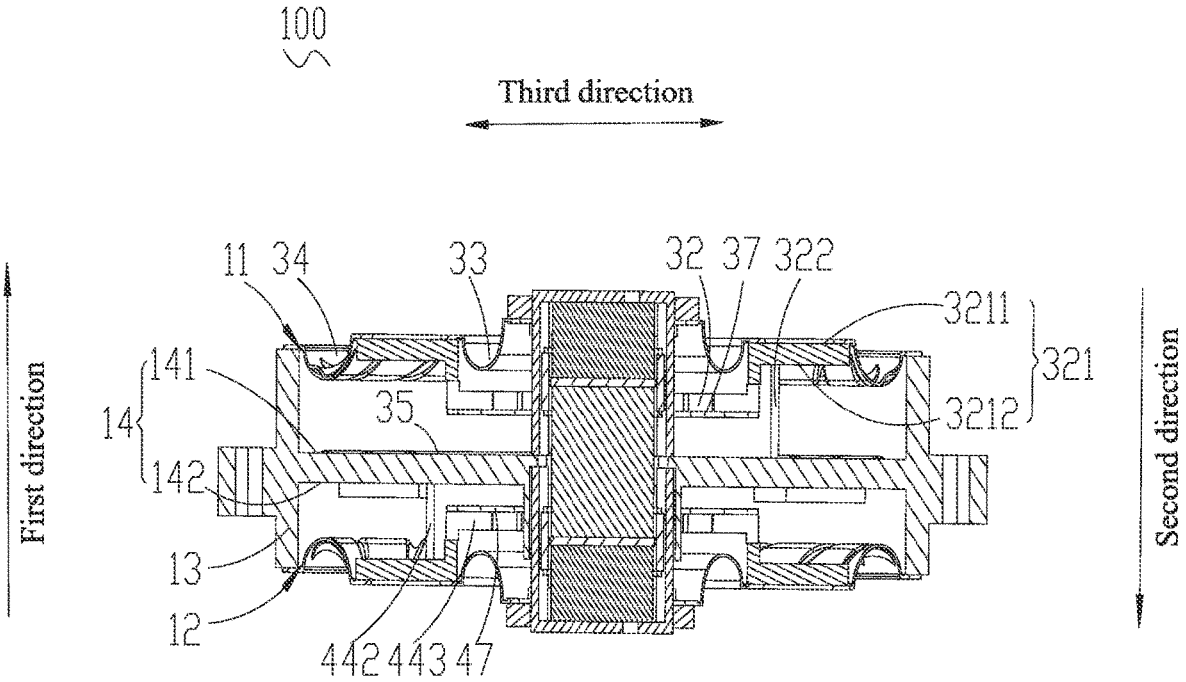
FIG. 4 is a sectional view of the sound generator shown in FIG. 1 along the direction P-P.

As shown in conjunction with FIG. 3 and FIG. 4, the magnetic circuit system 2 comprises a first magnet 21, a second magnet 22, and a third magnet 23 that are sequentially spaced and oppositely disposed in the second direction. The polarity of a magnetic pole, which is opposite to the second magnet 22, of the first magnet 21 is the same as the polarity of a magnetic pole, which is opposite to the first magnet 21, of the second magnet 22. The polarity of a magnetic pole, which is opposite to the third magnet 23, of the second magnet 22 is the same as the polarity of a magnetic pole, which is opposite to the second magnet 22, of the third magnet 23. It can be understood that the first magnet 21, the second magnet 22, and the third magnet 23 have a south pole and a north pole respectively, wherein the south pole of the first magnet 21 is disposed opposite the south pole of the second magnet 22, and the north pole of the second magnet 22 is disposed opposite the north pole of the third magnet 23; or the north pole of the first magnet 21 is disposed opposite the north pole of the second magnet 22, and the south pole of the second magnet 22 is disposed opposite the south pole of the third magnet 23, such that a magnetization direction of the first magnet 21 is opposite to the second magnet 22, and the magnetization direction of the second magnet 22 is opposite to the third magnet 23.

The first vibration system 3 may comprise a first voice coil 31, and the first voice coil 31 is sleeved on outer sides of the first magnet 21 and the second magnet 22 simultaneously. It can be understood that the first voice coil 31 has a ring structure with a hollow area where a part of the first magnet 21 and a part of the second magnet 22 are both located, and the first magnet 21 and the second magnet 22 may provide magnetic fields for the first voice coil 31 simultaneously, so that the first voice coil 31 vibrates under the simultaneous action of an alternating current of the first voice coil 31, the magnetic field of the first magnet 21, and the magnetic field of the second magnet 22.

The second vibration system 4 may comprise a second voice coil 41, and the second voice coil 41 is sleeved on outer sides of the second magnet 22 and the third magnet 23 simultaneously. It can be understood that the second voice coil 41 has a ring structure with a hollow area where a part of the second magnet 22 and a part of the third magnet 23 are both located, and the second magnet 22 and the third magnet 23 may provide magnetic fields for the second voice coil 41 simultaneously, so that the second voice coil 41 vibrates under the simultaneous action of the alternating current of the second voice coil 41, the magnetic field of the second magnet 22, and the magnetic field of the third magnet 23.

A sound generator in the related art generally has a magnet to cooperate with the first voice coil 31 and another magnet to cooperate with the second voice coil 41. Compared with the related art, the second magnet 22 of the present invention may provide magnetic fields for the first voice coil 31 and the second voice coil 41 simultaneously, which may improve the magnetic circuit efficiency of the magnetic circuit system 2, so that vibration amplitudes of the first voice coil 31 and the second voice coil 41 are increased, thereby improving the loudness of sound generated by the sound generator 100.

Figure 5:
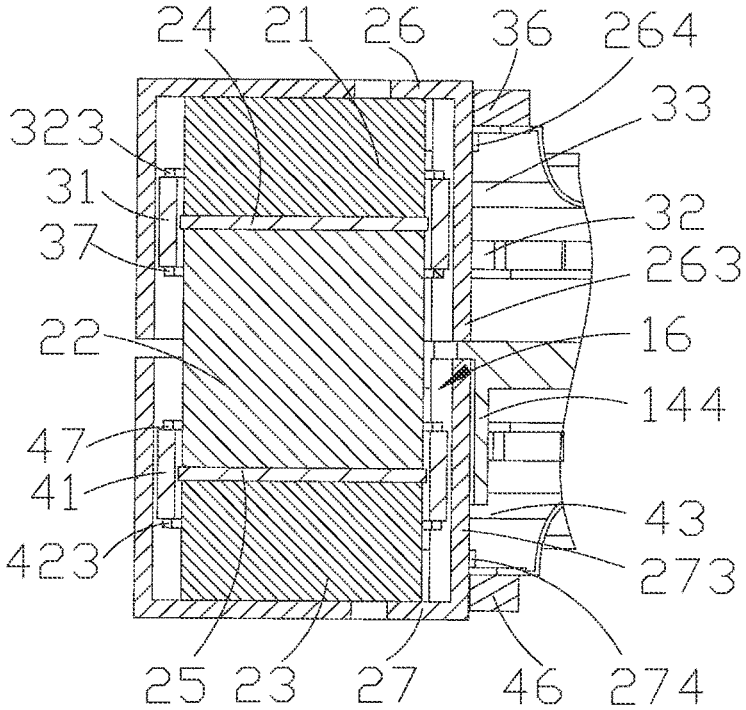
FIG. 5 is a partial sectional view of the sound generator shown in FIG. 1 along the direction P-P.

Referring to FIGS. 3-5, the magnetic circuit system 2 further comprises a first pole core 24 and a second pole core 25, and the first pole core 24 is disposed between the first magnet 21 and the second magnet 22 and is disposed opposite to the first voice coil 31 in a direction perpendicular to the first direction. It can be understood that the first pole core 24 is located at a spacing position between the first magnet 21 and the second magnet 22, and a part of the first magnet 21, the first pole core 24, and a part of the second magnet 22 are all located in the hollow area of the first voice coil 31. The first pole core 24 may direct the magnetic field generated by the first magnet 21 and the magnetic field generated by the second magnet 22 toward a direction perpendicular to the first voice coil 31.

The second pole core 25 is disposed between the second magnet 22 and the third magnet 23, and is disposed opposite to the second voice coil 41 in a direction perpendicular to the second direction. It can be understood that the second pole core 25 is located at a spacing position between the second magnet 22 and the third magnet 23, and a part of the second magnet 22, the second pole core 25, and a part of the third magnet 23 are all located in the hollow area of the second voice coil 41. The second pole core 25 may direct the magnetic field generated by the second magnet 22 and the magnetic field generated by the third magnet 23 toward a direction perpendicular to the second voice coil 41.

In the present invention, a center point of the first voice coil 31 coincides with a center point of the first pole core 24. For example, the cross section of the first voice coil 31 in a third direction perpendicular to the first direction is a circular ring, the first pole core 24 is a cylinder, and the center of the circular ring of the first voice coil 31 coincides with the center of the cylinder of the first pole core 24, that is, the first pole core 24 is located at a central position of the first voice coil 31. In this case, driving forces of the magnetic fields provided by the first magnet 21, the second magnet 22, and the first pole core 24 for the first voice coil 31 may be the strongest, thereby further improving vibration effects of the first voice coil 31. A center point of the second voice coil 41 coincides with a center point of the second pole core 25. For example, the structure of the second voice coil 41 is the same as the shape of the first voice coil 31, both of which are annular, the second pole core 25 and the first pole core 24 have the same shape, both of which are cylindrical, and the center of the circular ring of the second voice coil 41 coincides with the center of the cylinder of the second pole core 25, that is, the second pole core 25 is located at a central position of the second voice coil 41. In this case, driving forces of the magnetic fields provided by the second magnet 22, the third magnet 23, and the second pole core 25 for the second voice coil 41 may be maximized, thereby further improving vibration effects of the second voice coil 41.

The size of the first magnet 21 is the same as that of the third magnet 23, wherein the size comprises length, width, and height. The area of the cross section of the second magnet 22 in the third direction perpendicular to the first direction is equal to that of the cross section of the first magnet 21 in the third direction, and the height of the second magnet 22 in the first direction is greater than that of the first magnet 21 in the first direction. For example, the first magnet 21, the second magnet 22, and the third magnet 23 all have cylindrical structures. The diameter and height of the first magnet 21 are both the same as those of the third magnet 23. The area of the cross section of the first magnet 21 in the third direction is equal to that of the cross section of the second magnet 22 in the third direction, that is, the diameter of the first magnet 21, the diameter of the second magnet 22, and the diameter of the third magnet 23 are all equal. When the first magnet 21, the second magnet 22, and the third magnet 23 are all fixedly connected to the bracket 1, outer surfaces of the first magnet 21, the second magnet 22, and the third magnet 23 are flush in the first direction.

The magnetic circuit system 2 may further comprise a first magnetic frame 26 provided with a first receiving space 261 where the first magnet 21, a part of the second magnet 22, the first pole core 24, and the first voice coil 31 are all accommodated. The first magnetic frame 26 may comprise a top wall 262, a plurality of first side walls 263, and a plurality of first limiting portions 264. The plurality of first side walls 263 surround the periphery of the top wall 262 to form the first receiving space 261 and are spaced apart from each other to form a first gap 265 between two adjacent first side walls 263, and each of the first limiting portions 264 is fixedly connected to the top wall 262 and located in the first gap 265 formed by the two adjacent first side walls 263.

The first limiting portion 264 may comprise a first section 2641, a second section 2642, and a third section 2643 that are sequentially connected. The second section 2642 is bent relative to the first section 2641 in the second direction, and the third section 2643 is bent relative to the second section 2642 in the third direction perpendicular to the first direction. The first section 2641 is connected to the top wall 262.

The magnetic circuit system 2 may further comprise a second magnetic frame 27, and the structure of the second magnetic frame 27 is the same as that of the first magnetic frame 26. For example, the second magnetic frame may be provided with a second receiving space 271 where the third magnet 23, a part of the second magnet 22, the second pole core 25, and the second voice coil 41 are all accommodated. The second magnetic frame 26 may comprise a bottom wall 272, a plurality of second side walls 273, and a plurality of second limiting portions 274. The plurality of second side walls 273 surround at the periphery of the bottom wall 272 to form a second receiving space 271 and are spaced apart from each other to form a second gap 275 between two adjacent second side walls 273, and each of the second limiting portions 274 is fixedly connected to the bottom wall 272 and located in the second gap 275 formed by the two adjacent second side walls 273.

The second limiting portion 274 may comprise a fourth section 2741, a fifth section 2742, and a sixth section 2743 that are sequentially connected. The fifth section 2742 is bent relative to the fourth section 2741 in the second direction, and the sixth section 2743 is bent relative to the fifth section 2742 in the third direction perpendicular to the first direction. The fourth section 2741 is connected to the bottom wall 272.

Figure 6:
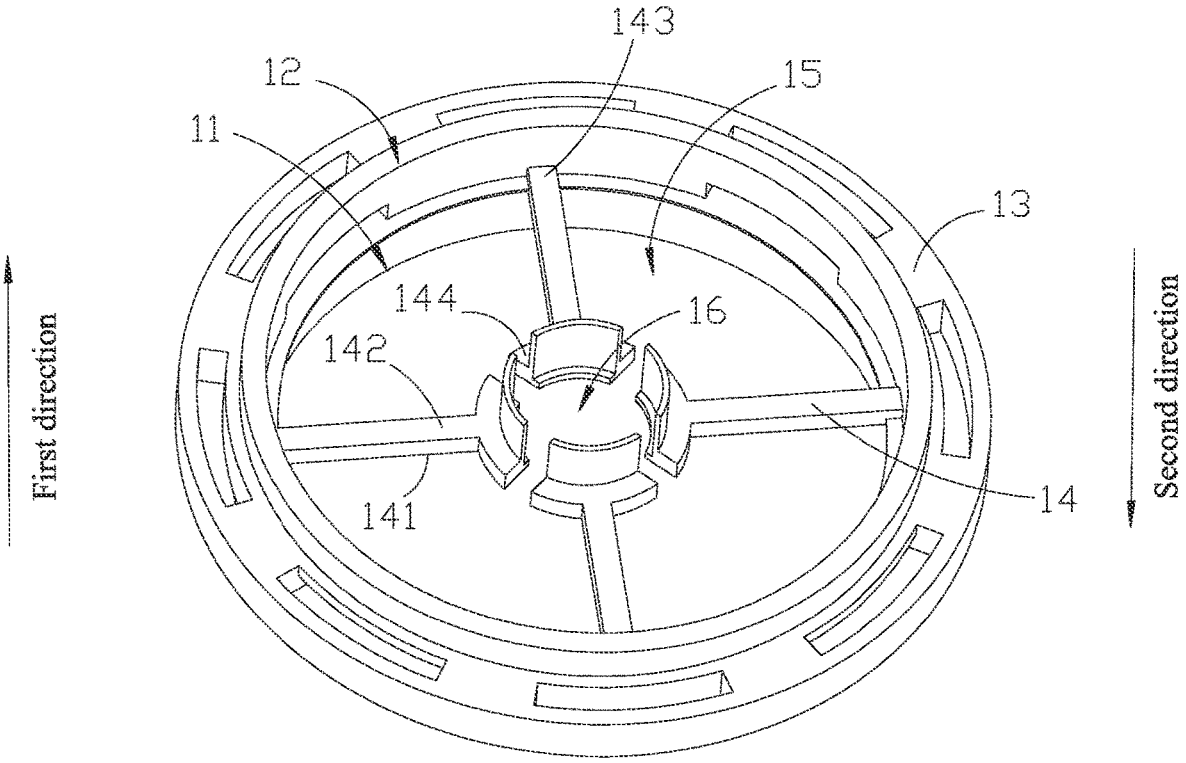
FIG. 6 is a schematic structural diagram of a bracket in the sound generator shown in FIG. 3.

As shown in conjunction with FIG. 4 and FIG. 6, the bracket 1 may comprise a body portion 13 and a plurality of bearing portions 14 spaced apart from each other. The body portion 13 is provided with an accommodation space 15 that may accommodate the magnetic circuit system 2, the first vibration system 3, and the second vibration system 4. The plurality of bearing portions 14 have the same structures, and each of the bearing portions 14 may have a plurality of end surfaces. For example, the bearing portion 14 may comprise a first end surface 141 and a second end surface 142 that are disposed back to back. The first end surface 141 is disposed to face the first opening 11 and may bear the first vibration system 3, and the second end surface 142 is disposed to face the second opening 12 and may bear the second vibration system 4. Each of the bearing portions 14 also has a first end portion 143 and a second end portion 144 that are disposed back to back. The first end portion 143 of each of the bearing portions 14 is connected to the side of the body portion 13 that faces the accommodation space 15, and the second end portions 144 of the plurality of bearing portions 14 surround to form a mounting channel 16 where the second end surface 142 is located.

Each of the first side walls 263 of the first magnetic frame 26 is connected to the first end surface 141 of each of the bearing portions 14. For example, the first magnetic frame 26 may comprise four first side walls 263, the bracket 1 may comprise four bearing portions 14, and one of the first side walls 263 is connected to the first end surface 141 of one of the bearing portions 14, such that the first magnetic frame 26 is fixedly connected to the bracket 1.

The second magnetic frame 27 may be disposed in the mounting channel 16, and each of the second side walls 273 of the second magnetic frame 27 is connected to the second end surface 142 of each of the bearing portions 14, such that the second magnetic frame 27 is fixedly connected to the bracket 1.

Figure 8:
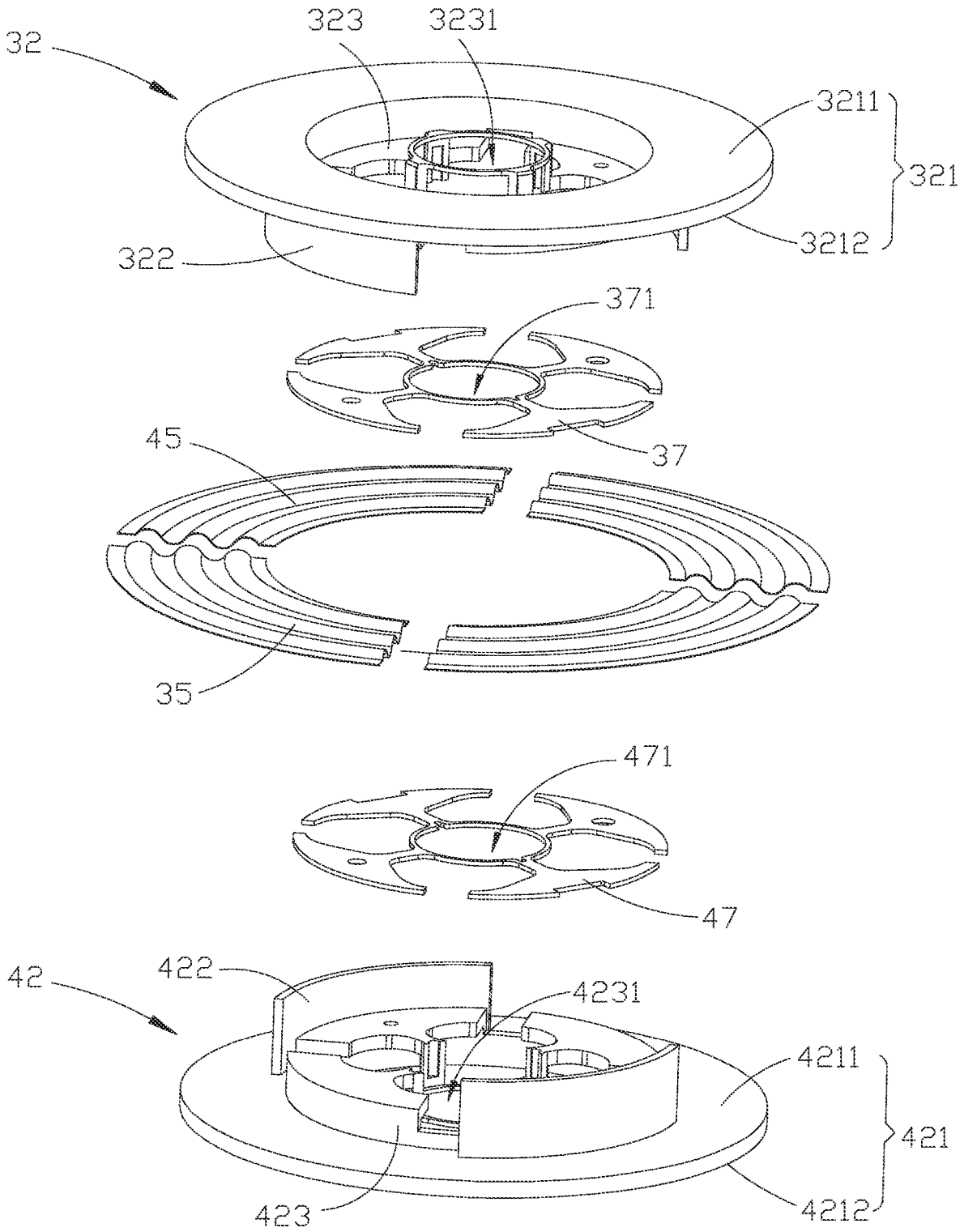
FIG. 8 is a partial exploded view of the sound generator shown in FIG. 2.

As shown in FIG. 2, FIG. 5, and FIG. 8, the first vibration system 3 may further comprise a first dome 32, a first sound membrane 33, a second sound membrane 34, a first damper assembly 35, and a first connection piece 36. The first connection piece 36 is connected to the first magnetic frame 26 and the first sound membrane 33 simultaneously. The first voice coil 31, the first sound membrane 33, the second sound membrane 34, and the first damper assembly 35 are all connected to the first dome 32, such that the first dome 32, the first sound membrane 33, and the second sound membrane 34 may vibrate together with the first voice coil 31 and generate sound in the first direction. The first dome 32 may comprise a first main body portion 321, two first connection portions 322 disposed oppositely, and a first holding portion 323 connected to the first main body portion 321. The first main body portion 321 has a first surface 3211 facing away from the second opening 12 and a second surface 3212 facing the second opening 12. The two first connection portions 322 disposed oppositely are both disposed on the second surface 3212, and one of the first connection portions 322 is disposed between two adjacent bearing portions 14 or at a spacing position between two bearing portions 14. The first holding portion 323 is provided with a first through hole 3231. The first holding portion 323 is sleeved on the outer side of the first magnet 21 through the first through hole 3231 and connected to the side of the first voice coil 31 that is close to the top wall 262.

The first sound membrane 33 is provided with a first aperture 331, sleeved on an outer side of the first magnetic frame 26 through the first aperture 331 and connected to the plurality of first limiting portions 264 of the first magnetic frame 26 and the first main body portion 321 of the first dome 32 simultaneously. For example, the first sound membrane 33 may comprise a first connection surface 332 facing the second opening 12 and a second connection surface 333 facing away from the second opening 12. A part of the first connection surface 332 that is close to the first aperture 331 is connected to the third sections 2643 of the plurality of first limiting portions 264, and a part of the first connection surface 332 that faces away from the first aperture 331 is connected to the first main body portion 321 of the first dome 32.

The first connection piece 36 is provided with a first connection hole 361 and is fixedly connected to the first magnetic frame 26 through the first connection hole 361, and the side of the first connection piece 36 that faces the second opening 12 is connected to the second connection surface 333 of the first sound membrane 33.

The second sound membrane 34 is disposed on an outer side of the first sound membrane 33 and connected between the body portion 13 of the bracket 1 and the first main body portion 321 of the first dome 32. For example, the second sound membrane 34 has a through hole, a surface facing the second opening, and another surface facing away from the second opening. A part of the surface facing the second opening that is close to the through hole is connected to the side of the first main body portion 321 that faces away from the first sound membrane 33, and a part of the surface facing the second opening that faces away from the though hole is connected to the end surface of the body portion 13 that faces away from the accommodation space 15 in the first direction. The first sound membrane 33 is located in the through hole of the second sound membrane 34.

The second vibration system 4 may further comprise a second dome 42, a third sound membrane 43, a fourth sound membrane 44, a second damper assembly 45, and a second connection piece 46. The first connection piece 36 is connected to the first magnetic frame 26 and the first sound membrane 33 simultaneously. The first voice coil 31, the first sound membrane 33, the second sound membrane 34, and the first damper assembly 35 are all connected to the first dome 32, such that the first dome 32, the first sound membrane 33, and the second sound membrane 34 may vibrate together with the first voice coil 31 and generate sound in the first direction.

The structure of the second dome 42 may be the same as that of the first dome 32. For example, the second dome 42 may also comprise a second main body portion 421, two second connection portions 422 disposed oppositely, and a second holding portion 423 connected to the second main body portion 421. The second main body portion 421 has a third surface 4211 facing away from the second opening 12 and a fourth surface 4212 facing the second opening 12. The two second connection portions 422 disposed oppositely are both disposed on the fourth surface 4212, and one of the second connection portions 422 is disposed between two adjacent bearing portions 14 or at a spacing position between two bearing portions 14. The second holding portion 423 is provided with a second through hole 4231, sleeved on the outer side of the second magnet 22 through the second through hole 4231 and connected to the side of the second voice coil 41 that is close to the bottom wall 272. Of course, the structure of the second dome 42 may also be different from that of the first dome 32.

The structure of the third sound membrane 43 may be the same as that of the first sound membrane 33. For example, the third sound membrane 43 is provided with a second aperture 431, sleeved on an outer side of the second magnetic frame 27 through the second aperture 431 and connected to the plurality of second limiting portions 274 of the second magnetic frame 27 and the second main body portion 421 of the second dome 42 simultaneously. For example, the third sound membrane 43 may comprise a third connection surface 432 facing the first opening 11 and a fourth connection surface 433 facing away from the first opening 11. A part of the third connection surface 432 that is close to the second aperture 431 is connected to the sixth sections 2743 of the plurality of second limiting portions 274, and a part of the third connection surface 432 that faces away from the second aperture 431 is connected to the second main body portion 421 of the second dome 42. Of course, the structure of the third sound membrane 43 may also be different from that of the first sound membrane 33.

The structure of the second connection piece 46 may be the same as that of the first connection piece 36. For example, the second connection piece 46 is provided with a second connection hole 461 and is fixedly connected to the second magnetic frame 27 through the second connection hole 461, and the side of the second connection piece 46 that faces the first opening 11 is connected to the fourth connection surface 433 of the third sound membrane 43. Of course, the structure of the second connection piece 46 is the same as that of the first connection piece 36.

The structure of the fourth sound membrane 44 may be the same as that of the second sound membrane 34. The fourth sound membrane 44 is disposed on an outer side of the third sound membrane 43, and the fourth sound membrane 44 is connected between the body portion 13 of the bracket 1 and the second main body portion 421 of the second dome 42. For example, the fourth sound membrane 44 has a through hole, a surface facing the first opening 11, and another surface facing away from the first opening 11. A part of the surface facing the first opening 11 that is close to the through hole is connected to the side of the second main body portion 421 that faces away from the third sound membrane 43, and a part of the surface facing the first opening 11 that faces away from the through hole is connected to the other end surface of the body portion 13 that faces away from the accommodation space 15 in the second direction. The third sound membrane 43 is located in the through hole of the fourth sound membrane 44. Of course, the structure of the fourth sound membrane 44 may also be different from that of the second sound membrane 34.

Still referring to FIG. 8, the first damper assembly 35 may comprise two first dampers disposed oppositely, with one of them disposed between two adjacent bearing portions 14 and connected to one of the first connection portions 322 and the other disposed between the other two adjacent bearing portions 14 and connected to the other of the first connection portions 322. The second damper assembly 45 may comprise two second dampers disposed oppositely, with one of them disposed between the two first dampers and located between two adjacent bearing portions 14 and the other also connected to one of the second connection portions 422. For example, the bracket 11 may comprise a first bearing portion, a second bearing portion, a third bearing portion, and a fourth bearing portion that are disposed at intervals in sequence. One of the first dampers is disposed at a spacing position between the first bearing portion and the second bearing portion, and the other of the first dampers is disposed at a spacing position between the third bearing portion and the fourth bearing portion. One of the second dampers is disposed at a spacing position between the second bearing portion and the third bearing portion, and the other of the second dampers is disposed at a spacing position between the first bearing portion and the fourth bearing portion.

Figure 7:
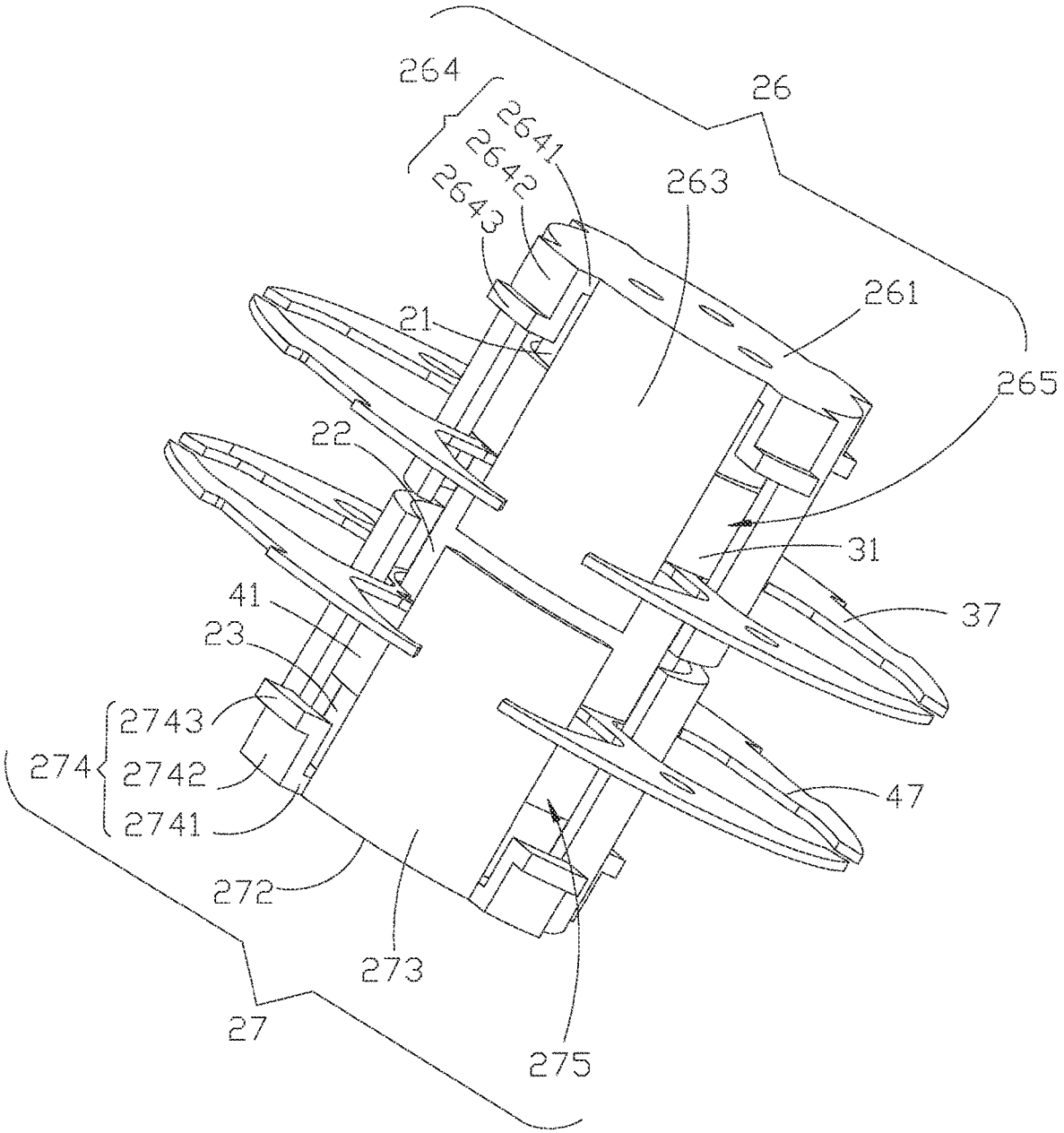
FIG. 7 is a schematic diagram of the connection of a magnetic circuit system, a first voice coil, a second voice coil, a first reinforcement piece, and a second reinforcement piece in the sound generator shown in FIG. 3.

Still referring to FIG. 7 and FIG. 8, the first vibration system 3 further comprises a first reinforcement piece 37. The first reinforcement piece 37 is provided with a third through hole 371, sleeved on the outer side of the second magnet 22 through the third through hole 371 and connected to the side of the first voice coil 31 that faces away from the top wall 262. The first reinforcement piece 37 also has a first connection structure extending from the inside of the first receiving space 261 of the first magnetic frame 26 toward the outside of the first receiving space 261, and the first connection structure is connected to the first dome 32. The first reinforcement piece 37 may vibrate together with the first voice coil 31 and the first dome 32. Compared with the connection between only the first holding portion 323 of the first dome 32 and the first voice coil 31, the first reinforcement piece 37 can increase the connection strength between the first dome 32 and the first voice coil 31, thereby improving the vibration effect that the first voice coil 31 drives the first dome 32 to vibrate together.

The second vibration system 4 further comprises a second reinforcement piece 47. The structure of the second reinforcement piece 47 may be the same as that of the first reinforcement piece 37. For example, the second reinforcement piece 47 is provided with a fourth through hole 471, sleeved on the outer side of the second magnet 22 through the fourth through hole 471 and connected to the side of the second voice coil 41 that faces away from the bottom wall 272. The second reinforcement piece 47 also has a second connection structure extending from the inside of the second receiving space 271 of the second magnetic frame 27 toward the outside of the second receiving space 271, and the second connection structure is connected to the second dome 42. The second reinforcement piece 47 may vibrate together with the second voice coil 41 and the second dome 42. Compared with the connection between only the second holding portion 423 of the second dome 42 and the second voice coil 41, the second reinforcement piece 47 may increase the connection strength between the second dome 42 and the second voice coil 41, thereby improving the vibration effect that the second voice coil 41 drives the second dome 42 to vibrate together. Of course, the structure of the second reinforcement piece 47 may also be different from that of the first reinforcement piece 37.

The foregoing descriptions are merely embodiments of the present invention. It should be noted here that for those of ordinary skills in the art, improvements can be made without departing from the inventive concept of the present invention, and these improvements should all fall within the protection scope of the present invention.

What is claimed is:

1. A sound generator, comprising a bracket, and a magnetic circuit system, a first vibration system, and a second vibration system that are fixedly connected to the bracket, wherein the bracket has a first opening and a second opening that face opposite directions, the magnetic circuit system is used for driving the first vibration system to generate sound in a first direction from the second opening toward the first opening and driving the second vibration system to generate sound in a second direction opposite to the first direction, the first vibration system comprises a first voice coil, and the second vibration system comprises a second voice coil, wherein the magnetic circuit system comprises a first magnet, a second magnet, and a third magnet that are sequentially spaced and oppositely disposed in the second direction, wherein the polarity of a magnetic pole, which is opposite to the second magnet, of the first magnet is the same as the polarity of a magnetic pole, which is opposite to the first magnet, of the second magnet, the polarity of a magnetic pole, which is opposite to the third magnet, of the second magnet is the same as the polarity of a magnetic pole, which is opposite to the second magnet, of the third magnet, the first voice coil is sleeved on outer sides of the first magnet and the second magnet simultaneously, and the second voice coil is sleeved on outer sides of the second magnet and the third magnet simultaneously, wherein the magnetic circuit system further comprises a first pole core and a second pole core, wherein the first pole core is disposed between the first magnet and the second magnet and is disposed opposite to the first voice coil in a direction perpendicular to the first direction, and the second pole core is disposed between the second magnet and the third magnet and is disposed opposite to the second voice coil in a direction perpendicular to the second direction.

2. The sound generator as described in claim 1, wherein a center point of the first voice coil coincides with a center point of the first pole core, and a center point of the second voice coil coincides with a center point of the second pole core.

3. The sound generator as described in claim 1, wherein the size of the first magnet is the same as that of the third magnet, the area of the cross section of the second magnet in a third direction perpendicular to the first direction is equal to that of the cross section of the first magnet in the third direction, and the height of the second magnet in the first direction is greater than that of the first magnet in the first direction.

4. The sound generator as described in claim 1, wherein the magnetic circuit system further comprises a first magnetic frame and a second magnetic frame, wherein the first magnetic frame is provided with a first receiving space where the first magnet, a part of the second magnet, the first pole core, and the first voice coil are all accommodated, and the second magnetic frame is provided with a second receiving space where the third magnet, a part of the second magnet, the second pole core, and the second voice coil are all accommodated.

5. The sound generator as described in claim 4, wherein the first magnetic frame comprises a top wall, a plurality of first side walls spaced apart from each other, and a plurality of first limiting portions, wherein the plurality of first side walls spaced apart from each other surround the periphery of the top wall to form the first receiving space, and each of the first limiting portions is fixedly connected to the top wall and located between two adjacent ones of the first side walls; and the second magnetic frame comprises a bottom wall, a plurality of second side walls spaced apart from each other, and a plurality of second limiting portions, wherein the plurality of second side walls spaced apart from each other surround the periphery of the bottom wall to form the second receiving space, and each of the second limiting portions is fixedly connected to the bottom wall and located between two adjacent ones of the second side walls.

6. The sound generator as described in claim 5, wherein the bracket comprises a body portion and a plurality of bearing portions spaced apart from each other, wherein the body portion is provided with an accommodation space, and each of the bearing portions has a first end portion and a second end portion that are disposed back to back, a first end surface facing the first opening, and a second end surface facing the second opening, wherein the first end portion of each of the bearing portions is connected to the side of the body portion that faces the accommodation space, the second end portions of the bearing portions surround to form a mounting channel where the second end surface is located and a part of the second magnetic frame is disposed, each of the second side walls is connected to the second end surface of each of the bearing portions, and each of the first side walls is connected to the first end surface of each of the bearing portions.

7. The sound generator as described in claim 6, wherein the first vibration system further comprises a first dome which comprises a first main body portion, two first connection portions disposed oppositely, and a first holding portion connected to the first main body portion, wherein the first main body portion has a first surface facing the first opening and a second surface facing the second opening, the two first connection portions disposed oppositely are disposed on the second surface with one of them disposed between two adjacent ones of the bearing portions, and the first holding portion is provided with a first through hole, sleeved on the outer side of the first magnet through the first through hole and connected to the side of the first voice coil that is close to the top wall; and the second vibration system further comprises a second dome disposed on the side of the bearing portion that faces away from the first magnetic frame, the second dome comprising a second main body portion, two second connection portions disposed oppositely, and a second holding portion, wherein the second main body portion has a third surface facing the first opening and a fourth surface facing the second opening, the two second connection portions disposed oppositely are disposed on the third surface with one of them disposed between two adjacent ones of the bearing portions and the other located between the two first connection portions disposed oppositely, and the second holding portion is provided with a second through hole, sleeved on the outer side of the second magnet through the second through hole and connected to the side of the second voice coil that is close to the bottom wall.

8. The sound generator as described in claim 7, wherein the first vibration system further comprises a first sound membrane and a second sound membrane located on an outer side of the first sound membrane, wherein the first sound membrane is provided with a first aperture, sleeved on an outer side of the first magnetic frame through the first aperture and has a first connection surface facing the second opening, a part of the first connection surface that is close to the first aperture being connected to the plurality of first limiting portions, and a part of the first connection surface that faces away from the first aperture being connected to the first main body portion, and the second sound membrane is connected between the first main body portion and the body portion; and the second vibration system further comprises a third sound membrane and a fourth sound membrane located on an outer side of the third sound membrane, wherein the third sound membrane is provided with a second aperture, sleeved on an outer side of the second magnetic frame through the second aperture and has a second connection surface facing the first opening, a part of the second connection surface that is close to the second aperture being connected to the plurality of second limiting portions, and a part of the second connection surface that faces away from the second aperture being connected to the second main body portion, and the fourth sound membrane is connected between the second main body portion and the body portion.

9. The sound generator as described in claim 5, wherein the first vibration system further comprises a first connection piece, which is provided with a first connection hole, fixedly connected to the first magnetic frame through the first connection hole and connected to the first sound membrane, and the second vibration system further comprises a second connection piece, which is provided with a second connection hole, fixedly connected to the second magnetic frame through the second connection hole and connected to the second sound membrane.

10. The sound generator as described in claim 2, wherein the magnetic circuit system further comprises a first magnetic frame and a second magnetic frame, wherein the first magnetic frame is provided with a first receiving space where the first magnet, a part of the second magnet, the first pole core, and the first voice coil are all accommodated, and the second magnetic frame is provided with a second receiving space where the third magnet, a part of the second magnet, the second pole core, and the second voice coil are all accommodated.

* * * * *